US009387713B2

(12) United States Patent
Schram et al.

(10) Patent No.: US 9,387,713 B2
(45) Date of Patent: Jul. 12, 2016

(54) REMOVABLE PRINT ELEMENT ASSEMBLY FOR A HAND PRINTER

(75) Inventors: Bob Schram, London (CA); Cameron Fink, London (CA)

(73) Assignee: Sterling Marking Products Inc., London (CA)

( * ) Notice: Subject to any disclaimer, the term of this patent is extended or adjusted under 35 U.S.C. 154(b) by 486 days.

(21) Appl. No.: 13/091,671

(22) Filed: Apr. 21, 2011

(65) Prior Publication Data

US 2011/0277651 A1 Nov. 17, 2011

Related U.S. Application Data

(60) Provisional application No. 61/334,756, filed on May 14, 2010.

(30) Foreign Application Priority Data

Oct. 5, 2010 (CA) ..... 2717256

(51) Int. Cl.

| | |
|---|---|
| ***B41K 1/56*** | (2006.01) |
| ***B41K 1/36*** | (2006.01) |
| *B41K 1/40* | (2006.01) |
| *B41J 1/02* | (2006.01) |
| *B41K 1/00* | (2006.01) |

(52) U.S. Cl.

CPC ... *B41K 1/36* (2013.01); *B41K 1/56* (2013.01); *B41J 1/02* (2013.01); *B41K 1/00* (2013.01); *B41K 1/40* (2013.01)

(58) Field of Classification Search

CPC ..... B41K 1/00; B41K 1/02; B41K 1/04; B41K 1/40; B41K 1/56; B41K 1/36

USPC ..... 101/103, 104, 327, 333, 334, 389.1, 101/405, 406; 211/39

See application file for complete search history.

(56) References Cited

U.S. PATENT DOCUMENTS

| | | | | |
|---|---|---|---|---|
| 1,489,057 A * | 4/1924 | Bornstein | ..... | 101/405 |
| 1,518,727 A * | 12/1924 | Bornstein | ..... | 101/405 |
| 2,829,594 A * | 4/1958 | Goc | ..... | 101/104 |

(Continued)

FOREIGN PATENT DOCUMENTS

| | | |
|---|---|---|
| CN | 1433356 | 5/2000 |
| EP | 0803372 | 4/1996 |

(Continued)

*Primary Examiner* — Daniel J Colilla
*Assistant Examiner* — Quang X Nguyen
(74) *Attorney, Agent, or Firm* — Thomas & Kasceski, PC

(57) ABSTRACT

A removable print element assembly can be installed on and removed from a hand stamp without the user's fingers ever being in close proximity to the print element (die). The removable print element assembly can be installed on and removed from a hand printer without the need for a friction fit fastener or mechanical linking device. The removable print element assembly is provided for a hand printer with a support element capable of magnetic engagement. The removable print element assembly comprises a print carrier having a surface for removable magnetic engagement with the support element of the hand printer, a removal actuator, and a print element (die) affixed to the print carrier. The surface for removable magnetic engagement with the hand printer is a magnetic. The surface for removable magnetic engagement with the hand printer is the surface of a magnet fixed to the print carrier.

18 Claims, 7 Drawing Sheets

(56) References Cited

U.S. PATENT DOCUMENTS

| | | | | | |
|---|---|---|---|---|---|
| 3,714,894 | A | * | 2/1973 | Robinson | 101/389.1 |
| 3,949,672 | A | | 4/1976 | Cadmus, Jr. | |
| 4,054,093 | A | | 10/1977 | Funahashi | |
| 4,291,622 | A | | 9/1981 | Bengtsson | |
| 4,362,101 | A | * | 12/1982 | Ahrens | 101/327 |
| 4,432,281 | A | | 2/1984 | Wall | |
| 4,986,175 | A | | 1/1991 | Boehringer | |
| 5,303,648 | A | | 4/1994 | Shih | |
| 5,313,885 | A | * | 5/1994 | Winston | 101/405 |
| 5,353,704 | A | | 10/1994 | Canto | |
| 5,709,145 | A | | 1/1998 | Shih | |
| 5,816,160 | A | | 10/1998 | Taira | |
| 5,819,650 | A | | 10/1998 | Shih | |
| 5,855,170 | A | | 1/1999 | Shih | |
| 6,047,639 | A | | 4/2000 | Shih | |
| 6,082,261 | A | | 7/2000 | Richards | |
| 6,112,662 | A | | 9/2000 | Okumura | |
| 6,189,450 | B1 | | 2/2001 | Shih | |
| 6,302,022 | B1 | | 10/2001 | Shih | |
| 6,526,882 | B1 | | 3/2003 | Shih | |
| 6,626,105 | B1 | | 9/2003 | Linehan | |
| 6,739,244 | B1 | | 5/2004 | Carbaugh | |
| 6,796,230 | B2 | | 9/2004 | Pichler | |
| D507,805 | S | | 7/2005 | Shih | |
| 6,920,825 | B1 | * | 7/2005 | Baxter | 101/327 |
| 7,124,684 | B1 | * | 10/2006 | Petersen | 101/333 |
| 7,506,582 | B2 | | 3/2009 | Petersen | |
| 7,717,038 | B2 | | 5/2010 | Raksha | |
| 8,104,402 | B2 | * | 1/2012 | Feilecker et al. | 101/327 |
| 2003/0217653 | A1 | | 11/2003 | Shih | |
| 2004/0035310 | A1 | | 2/2004 | Zindl | |
| 2004/0255801 | A1 | | 12/2004 | Shih | |
| 2005/0155504 | A1 | | 7/2005 | Shih | |
| 2005/0241507 | A1 | * | 11/2005 | Waters | 101/327 |
| 2006/0000374 | A1 | * | 1/2006 | Faber | 101/334 |
| 2006/0054037 | A1 | | 3/2006 | Shih | |
| 2009/0301327 | A1 | * | 12/2009 | Nelson | B41K 1/40 101/333 |
| 2011/0072991 | A1 | * | 3/2011 | Ando | 101/333 |

FOREIGN PATENT DOCUMENTS

| | | |
|---|---|---|
| EP | 1194296 | 4/2001 |
| WO | WO 0102185 | 1/2001 |

* cited by examiner

REMOVABLE PRINT ELEMENT ASSEMBLY FOR A HAND PRINTER

CROSS-REFERENCE TO RELATED APPLICATION(S)

This United States Non-Provisional Patent Application relies for priority on U.S. Provisional Patent Application Ser. No. 61/334,756, filed on May 14, 2010, and on Canadian Patent Application Serial No. 2,717,256, filed on Oct. 5, 2010, the contents of both of which are incorporated herein by reference.

FIELD OF THE INVENTION

The present invention relates to a hand printers, also commonly known as hand stamps and, more particularly to an interchangeable print element for a hand printer which allows the hand printer to be used to create multiple different print images utilizing a single hand printer.

DESCRIPTION OF RELATED ART

There are basically three types of hand printers in use today. The simplest type of hand printer, a conventional hand stamp, comprises a printer body which acts as a handle and supports a print element typically constructed of rubber or synthetic compounds. The print element is manually placed on an external ink source, most often a stamp pad, to load the print element with ink, and then the inked print element is touched to a substrate where the ink is transferred to create the desired image.

A more advanced hand printer, or self-inking stamp, is composed of a body, an enclosure movable with respect to the body, a support plate joined within the enclosure by a pin or joining mechanism, and a print element attached on the support plate. The hand stamp further uses a pivoting device to cause the support plate bearing the print element to reverse upon stamping a print so as to enable the print element to be stored within the enclosure when not in use. The print element is thus protected from abrasion and is stored in isolation within the hand stamp in order to prevent accidental transfer from the print element to external surfaces when the hand printer is not in use. A separate ink source is contained within the enclosure of the hand printer in the form of an ink reservoir or ink pad. U.S. Pat. No. 7,124,684 (Petersen) provides an example of such a device, known as a self-inking reciprocating stamp.

There are also hand printers, pre-inked stamps, which have a print element that is porous and contains the ink reservoir within the print element material providing the ink source. Ink then passes through the porous print element to make an image on a substrate when the print element is pressed against the substrate. In this type of printer no separate ink pad is required.

It is known to provide hand printers of this type with replaceable and interchangeable print elements. United States Publication No. 2006/054037 (Shih). The device has a die bracket with a bracket block, a transverse recess, two clips and a fastener bracket. The replaceable stamp die is detachably mounted on the bracket and has a fastener and a plug. The fastener is formed on a back edge of the die bracket and extends through a slot of the fastener bracket ink the die bracket. The plug is defined on a top end of the median tab and is mounted between the clips. In essence the detachable mounting feature relies upon a physical friction fit between the respective elements and the user must manipulate the fastener tabs with his/her fingers in order to release the die from the bracket in order to change the die. As with any fastener which relies upon a friction fit for its operation, frequent use can result in wear on cooperating elements, decreasing their fastening ability over time. Moreover, the die bracket is of necessity in close proximity to the print element (die) itself and there is the potential for a user's fingers to become inked if they come in contact with the print element during its removal or replacement.

SUMMARY OF THE INVENTION

One object of the present invention is to provide a removable print element assembly which can be installed on and removed from a hand stamp without the user's fingers ever being in close proximity to the print element (die).

Another object of the present invention is to provide a removable print element assembly which can be installed on and removed from a hand printer without the need for a friction fit fastener or mechanical linking device.

It is yet another object of the present invention is to provide a removable print element assembly which can be installed on and removed from a hand printer without any wear to the hand printer.

In accordance with one aspect of the present invention, a removable print element assembly is provided for a hand printer with a support element capable of magnetic engagement. The removable print element assembly comprises a print carrier having a surface for removable magnetic engagement with the support element of the hand printer, a removal actuator, and a print element (die) affixed to the print carrier. The surface for removable magnetic engagement with the hand printer is magnetic. The surface for removable magnetic engagement with the hand printer is the surface of a magnet fixed to the print carrier. The print carrier has a first side and a second side. The removal actuator and the surface for removable magnetic engagement are positioned on the first side of the print carrier, and the print element is affixed to the second side of the print carrier. The removal actuator comprises a raised projection having sufficient height to break the magnetic attraction between the support and the print carrier when the actuator is pressed in a direction opposite to the attractive magnetic force. The removal actuator comprises a first side wall and a second side wall, defining a channel there between, and the surface for removable magnetic engagement is located within the channel.

In accordance with another aspect of the present invention, a removable print element assembly is provided for a hand printer with a support element capable of magnetic engagement. The support element is a die plate. The removable print element assembly comprises a print carrier having a surface for removable magnetic engagement with the support element of the hand printer, a removal actuator, and a print element affixed to the print carrier. The surface for removable magnetic engagement is sufficiently strong to assure contact with the four corners of the die plate and the print carrier assembly.

A hand printer is provided comprising a removable print element assembly, a support element capable of magnetic engagement, a print carrier having a surface for removable magnetic engagement with the support element of the hand printer, a removal actuator, and a print element affixed to the print carrier.

Other objects, advantages and novel features of the invention will become more apparent from the following detailed description when taken in conjunction with the accompanying drawings.

DETAILED DESCRIPTION OF EMBODIMENT(S) OF THE INVENTION

Figure 1:
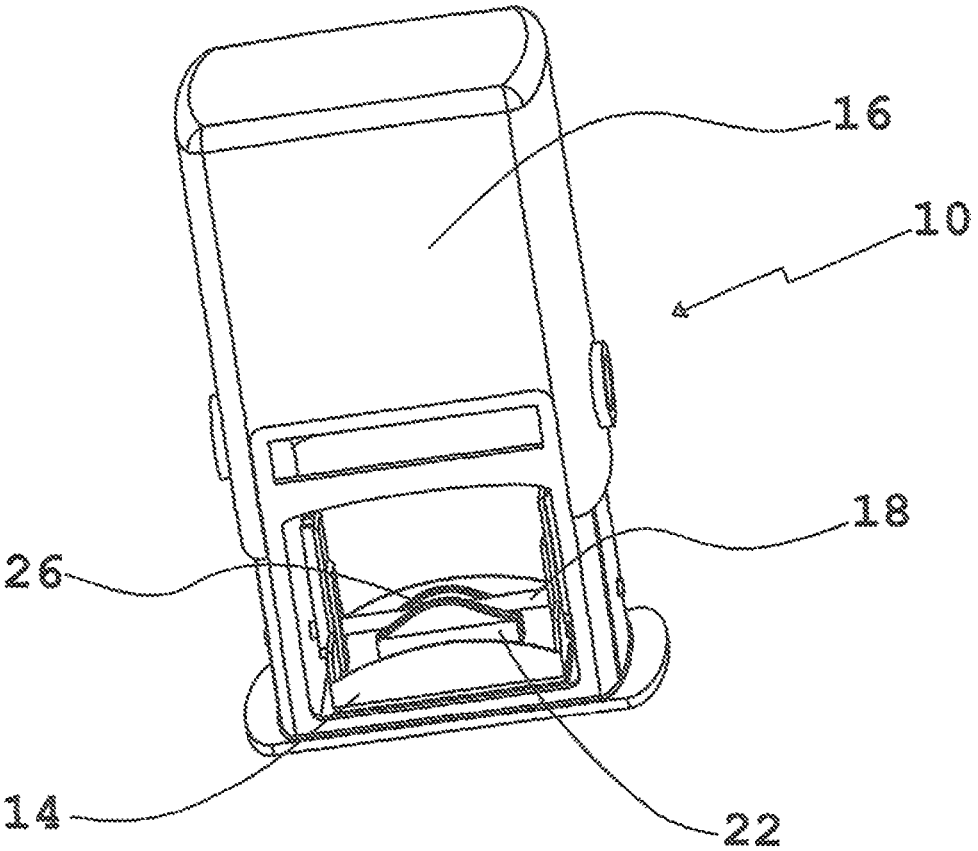
FIG. 1 is a perspective view showing the hand stamp having a removable print element assembly in accordance with a first embodiment of the present invention.
Figure 9:
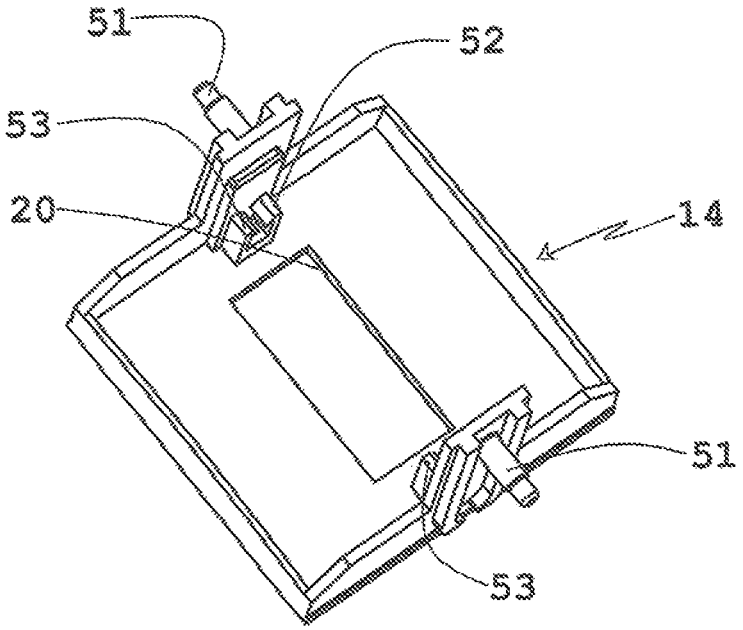
FIG. 9 is a perspective view a die plate in accordance with an alternative embodiment of the present invention.
Figure 10:
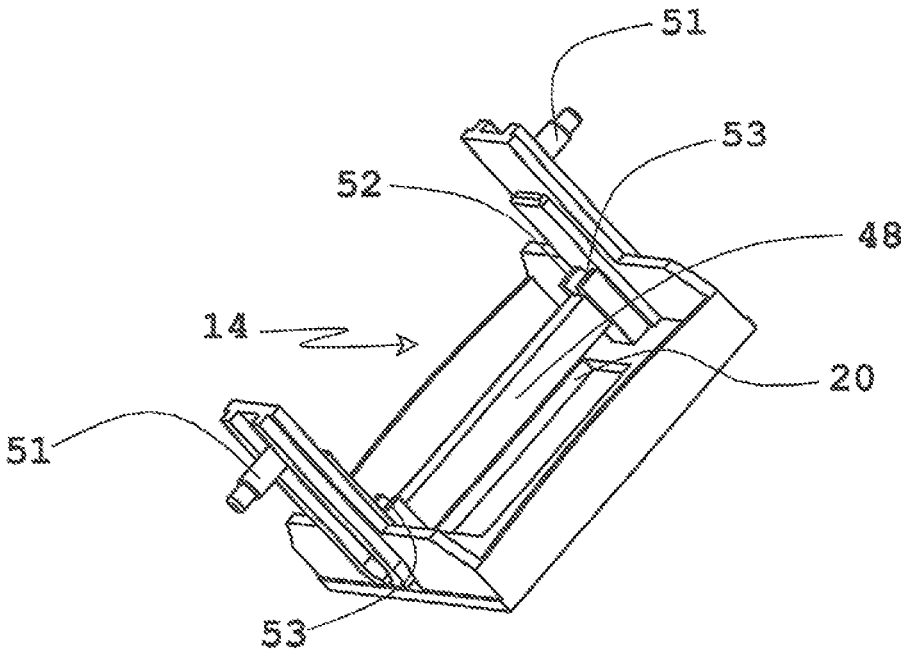
FIG. 10 is a second perspective view the die plate of FIG. 9, and also showing a support element which is capable of magnetic engagement.
Figure 11:
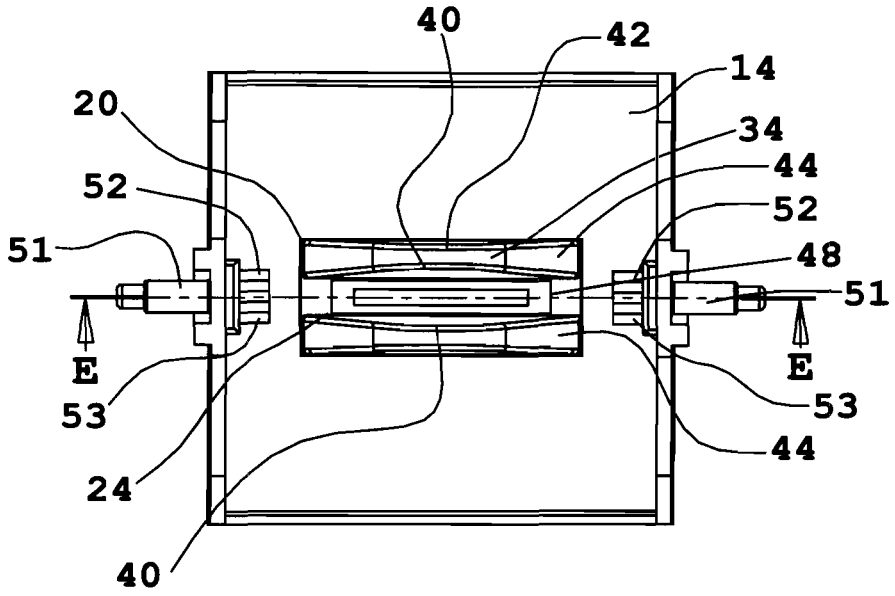
FIG. 11 is a plan view of the die plate of FIG. 10 with a removable print element assembly.

FIG. 1 of the drawings shows a hand printer having a removable print element assembly in accordance with a first embodiment of the present invention. The hand printer is shown generally by reference numeral 10. In the drawings of the embodiments of the present invention like elements will be labeled with the same reference numerals. Portions of the removable print element assembly 12 can be seen in FIG. 1, but the removable print element assembly 12 is shown fully in FIG. 2. As discussed above, various types of hand printers are known. In particular, there are manual hand printers consisting of a body and an attached print element for use with an external ink source, rotating self-inking hand printers having an internal ink reservoir or ink pad, and hand printers which have ink sources incorporated into the print element material. The present invention can be adapted for use with any of the foregoing types of hand printers. FIG. 1 depicts a conventional self-inking rotating hand printer. Since the construction and manner of operation of self-inking rotating hand printers are well known, the present description will not discuss these aspects in detail. The hand printer 10 has a die plate 14 which can be rotated between a retracted position inside the enclosure 16 of the printer 10, and a printing position as shown in FIG. 1 wherein the die plate 14 is extended outside the enclosure in order to bring a print element into contact with a substrate in order to transfer the ink and create a printed image. The die plate rotates about a horizontal shaft 18 or alternate pivot points which is mounted to the body of the printer or integral to the die plate 14. Details of an alternative embodiment, illustrated in FIGS. 9-11, employing pivot points instead of a horizontal shaft are provided below.

Reference is made in the claims to the hand printer having a support element which is capable of magnetic engagement. In the first embodiment of the present invention, shown in FIGS. 1-8, the horizontal shaft 18 functions as the support element. In the alternative embodiment of the invention, discussed in greater detail below, the die plate is being used as the support element. In all cases, the support element must be capable of magnetic engagement. It should be understood that in order for magnetic engagement for two objects to occur, one of the objects must be a magnet. The other object may be either a second magnet oriented for attractive polarity with the first object, or it may be a magnetic metal, meaning that it is attracted to the magnetic field of the magnet. In the present invention, the support element may either be, or comprise, a magnet, or it may be constructed from, or comprise a portion of magnetic metal without departing from the scope of the present invention. For illustration purposes, the horizontal shaft 18 is constructed from magnetic metal. It should be understood that it would also be possible to construct the horizontal shaft 18 from a material that is not a magnetic metal. In such instance, the die plate 14 would, itself, form the support element, wherein a portion of magnetic metal could be inset into the die plate of the printer 14 for magnetic engagement with the removable print element assembly 12. The die plate 14 defines a rectangular opening 20 (best seen in FIGS. 5 and 6).

The removable print element assembly 12 comprises a print carrier 22 having a surface 24 for removable magnetic engagement with the support element (in this embodiment shaft 18) of the hand printer 10. The assembly 12 has a removal actuator 26. A print element 28 (sometimes also referred to as the die) is affixed to the print carrier 22. The surface for removable magnetic engagement 24 with the hand printer 10 is magnetic, and can be constructed as a portion of magnet fixed to the print carrier 22. It is preferable for the magnet to be embedded in the print carrier 22. The print carrier 22 has a first side 30 and a second side 32 (best seen in FIG. 6). The removal actuator 26 and the surface for removable magnetic engagement 24 are positioned on the first side 30 of the print carrier 22. The print element 28 is affixed to the second side 32 of the print carrier 22.

Figure 3:
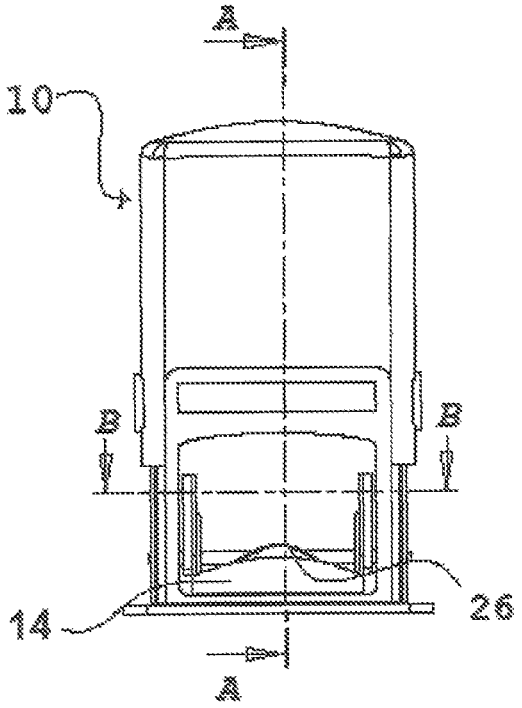
FIG. 3 is a side elevation of the hand printer of FIG. 1.
Figure 4:
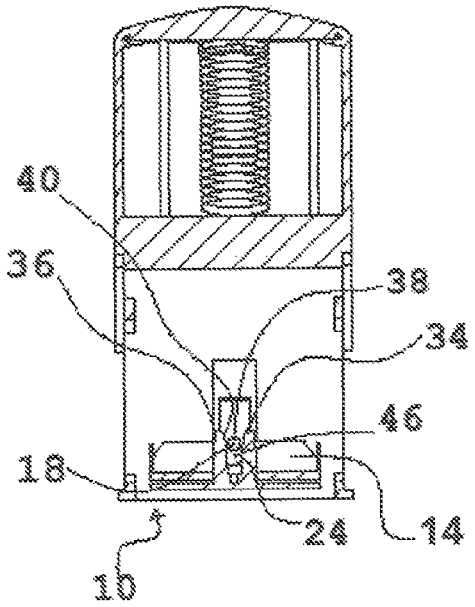
FIG. 4 is a cross-sectional view of the hand printer of FIG. 3 taken along line A-A.
Figure 5:
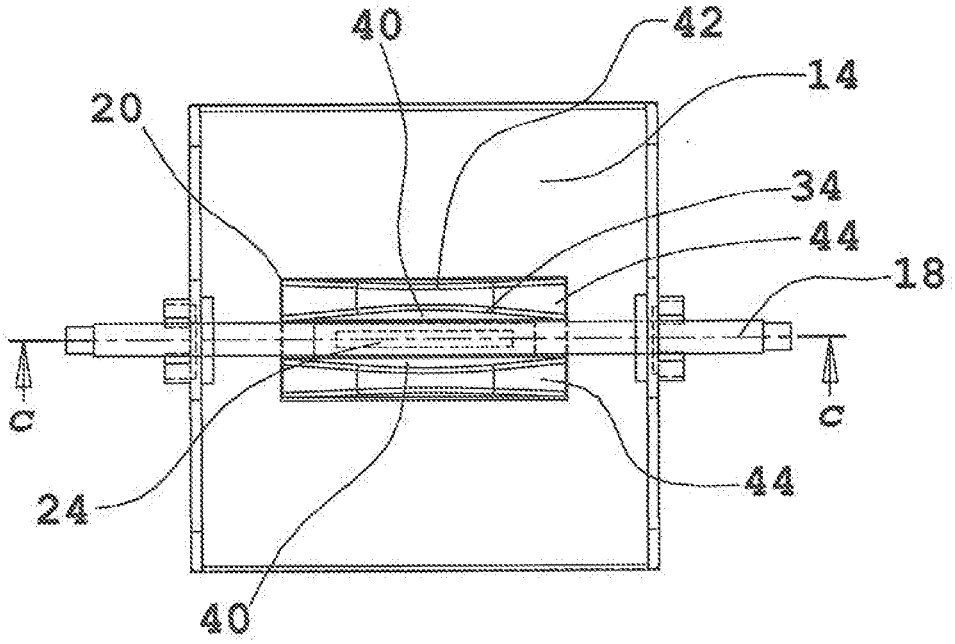
FIG. 5 is a partial section taken along line B-B of FIG. 3.
Figure 6:
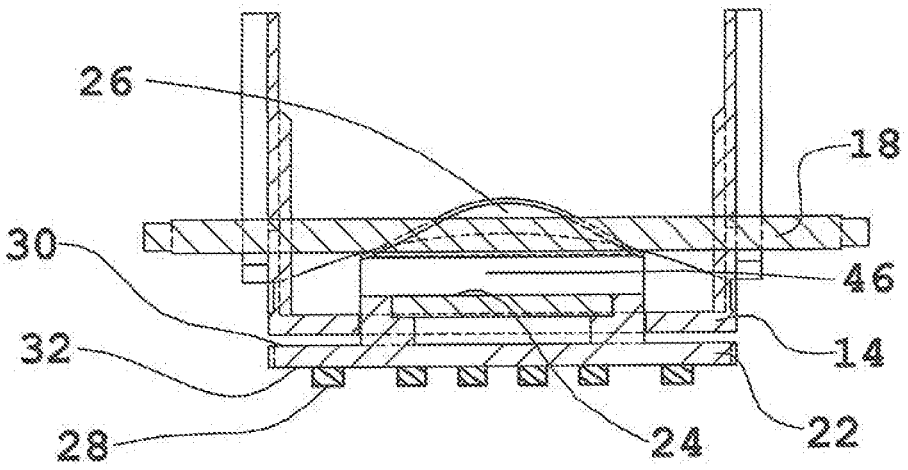
FIG. 6 is a partial sectional view of the hand stamp and removable print element assembly taken along line C-C in FIG. 5.
Figure 12:
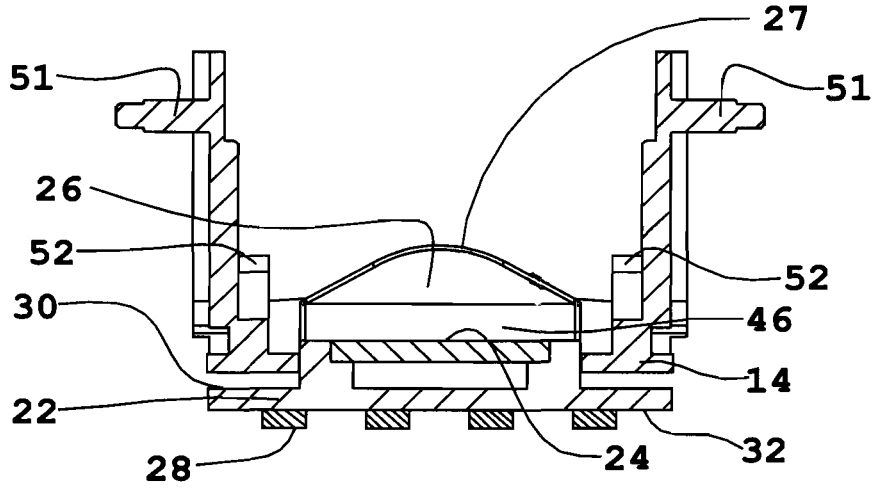
FIG. 12 is a section taken along line E-E of FIG. 11.

The print removal actuator comprises a raised projection 27 (best seen in FIGS. 8 and 12) having sufficient height to break the magnetic attraction between the support and the print carrier when the removal actuator is pressed in a direction opposite to the magnetic attraction. It is preferable for the removal actuator 26 to be positioned adjacent to the surface for removable magnetic engagement 24. In accordance with the preferred embodiment of the present invention, the removal actuator 26 comprises a first side wall 34 and a second side wall 36, defining a channel 38 there between. The surface for removable magnetic engagement is located within the channel. As can be seen in FIGS. 1, 3 and 6 the removal actuator 26 has a curved profile. When the print element assembly 12 is installed on a hand stamp, the removal actuator extends through the opening 20 in the die plate bringing the surface for removable magnetic engagement 24 into close proximity with the horizontal shaft 18 of the hand printer. FIGS. 3-6 illustrate the positions of the first side wall 34, the second side wall 36 and the channel 38 containing the magnetic surface 24 relative to the horizontal shaft 18. The curved profile of the removal actuator 26 acts as a guide to ease the removal actuator 26 through the opening 20 in the die plate.

Figure 2:
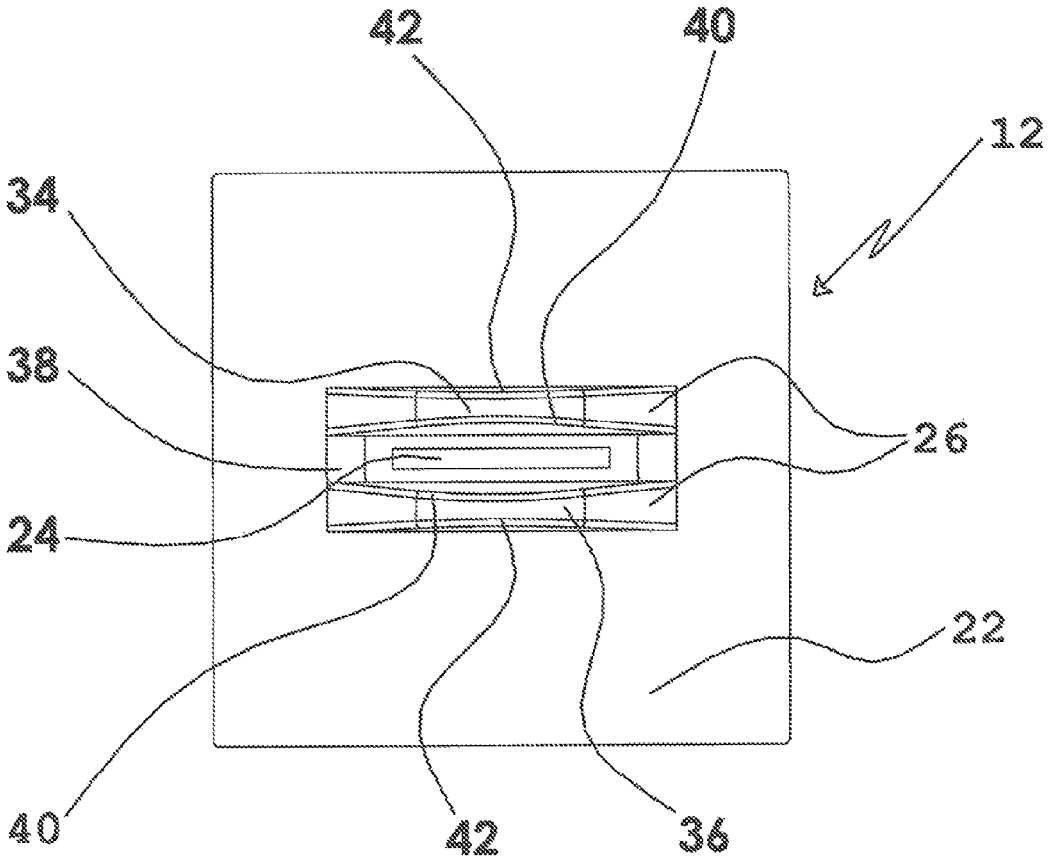
FIG. 2 is top plan view of the removable print element assembly in accordance with a first embodiment of the present invention.

The print element assembly 12 further comprises a guide for aligning the surface for removable magnetic engagement 24 on print carrier 22 with the support element (here shaft 18) of the hand printer 10. While other alignment guides may be contemplated, it is preferred in the present embodiment for the alignment guide to comprise an arrangement of tapering on the first 34 and second 36 walls of the removal actuator 16. As best seen in FIGS. 2 and 5, the alignment guide 40 is an inward tapering on each of the first 34 and second 36 side walls. FIG. 4 shows that the channel 38 is slightly wider at the top than the bottom, thus reflecting the tapering of the side walls 34, 36 which act as an alignment guide to urge the removal actuator into position with the horizontal shaft 18 aligned with the magnetic surface 24 within the channel 38. The longitudinal nature of the channel and the use of a corresponding longitudinal portion of magnet further serve as guides to align the print carrier with the support, (in the present embodiment, the longitudinal shaft 18).

There are also tapering on the outer sides of the first 34 and second 36 side walls to ease the side walls of the removal actuator 26 through the opening 20 in the die plate.

As shown in FIGS. 2 and 5, the side walls 34, 36 of the removal actuator 26 have thickened portions 44 at their respective outer edges. The thickened portions prevent excess relative movement between the print carrier and the shaft 18, improving the alignment between the print carrier and the printer.

The selection of magnetic materials for use in the present invention should be made having regard to the mass of the print carrier and the printer element, the surface tension which occurs when the print element contacts the ink source, and the centrifugal force which will occurs as the die platel4 rotates about the pivot point or horizontal shaft 18. Once the masses of the respective elements are known, the magnetic force needed to hold the print carrier in removable engagement with the support can be readily calculated, and a magnetic material having the desired specifications can be sourced from any known supplier. It is preferred that the print carrier will float magnetic attraction closely adjacent to, but outside physical contact with support shaft or material providing the magnetic engagement. This relationship is illustrated by reference numeral 46 in FIGS. 4 and 6 which show a very slight, but discernable gap between the magnetic surface 24 and the shaft 18. The absence of physical contact between the magnetic surface 24 and the shaft 18 provides that there is no friction to inhibit rotation of the die plate around the pivot point or shaft, and there is no wear and tear on the component parts at this location nor any interference with fit which could cause the die to be unstable effecting print quality. The lack of physical engagement also removes tolerance matching between parts which results in improved printer function. This feature enhances the smoothness of the printing operation and improves the functional lifespan of the hand printer.

The hand printer 10 can be constructed from any suitable material, typically a plastic, or polymer resin, but may include fiberglass, metals, etc. Since hand printers are well-known in the prior art, it is within the ability of a person skilled in the art to select an appropriate material from which to construct the hand printer.

In use, the removable print element assembly is operated in the following manner. To attach a removable print element assembly 12 to the hand printer 10, the die plate of the hand printer 10 is moved to its extended position with the die plate exposed. Hand printers typically have lock buttons which will allow them to be temporarily locked in this extended position. The hand printer is then poised above the removable print element assembly 12 in approximate alignment with the open channel 38 of the print carrier 22 between the open 20 in the die plate 14 and the horizontal shaft 18 of the printer, and the hand printer is moved toward the print element assembly 12. The attractive magnetic force between the element capable of magnetic engagement and the surface 24 for removable magnetic engagement with the support element will attract the print carrier toward the hand printer. The curvature and tapering of the removal actuator will guide the magnetic surface 24 in the channel 38 of the print carrier 22 into floating magnetic attraction closely adjacent to the horizontal shaft 18, while side walls 34, 36 of the removal actuator 26 pass through the opening 20 in the die plate 14. At the same time, the first side 30 of the print carrier 22 is brought into physical laminate contact with the die plate 14. An audible snapping noise can be heard when the print carrier 22 and the die plate 14 are brought into contact. The print element assembly is then attached to the hand printer. It should be noted that the attachment can be completed by a user touching only the enclosure 16 of the hand printer 10. The user does not need to touch the print carrier 22, or the print element 28. The hand printer does not have to be locked open to engage the print carrier into the hand printer for the magnetic engagement to take place.

Figure 7:
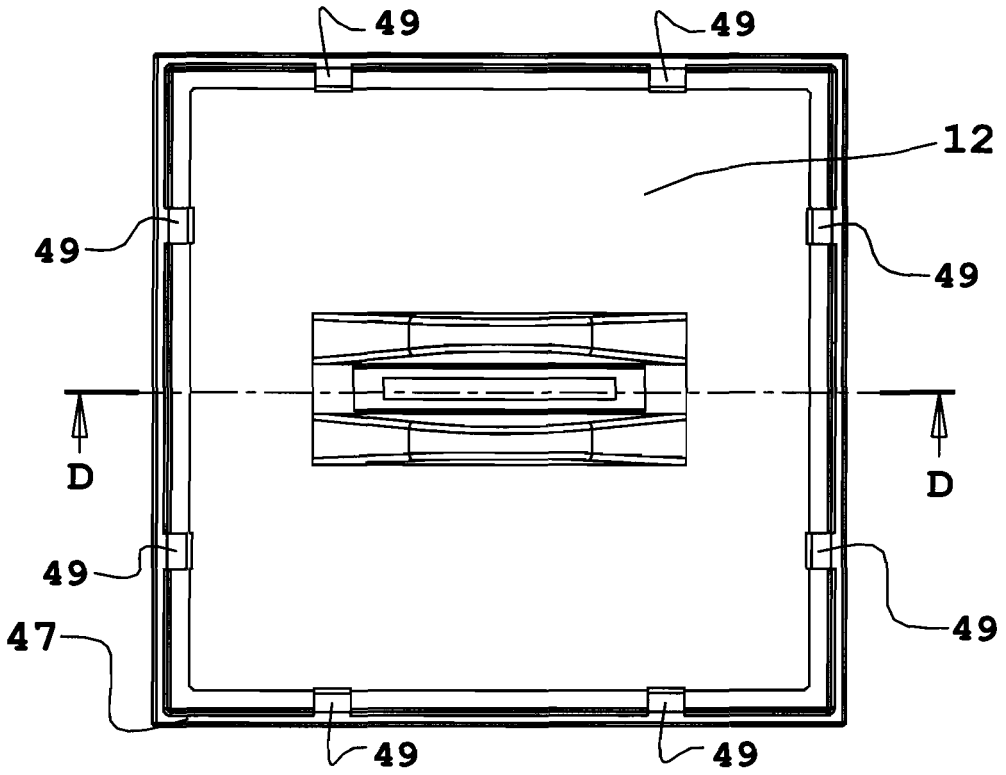
FIG. 7 is a plan view of the removable print element assembly in the storage cassette in accordance with the present invention.
Figure 8:
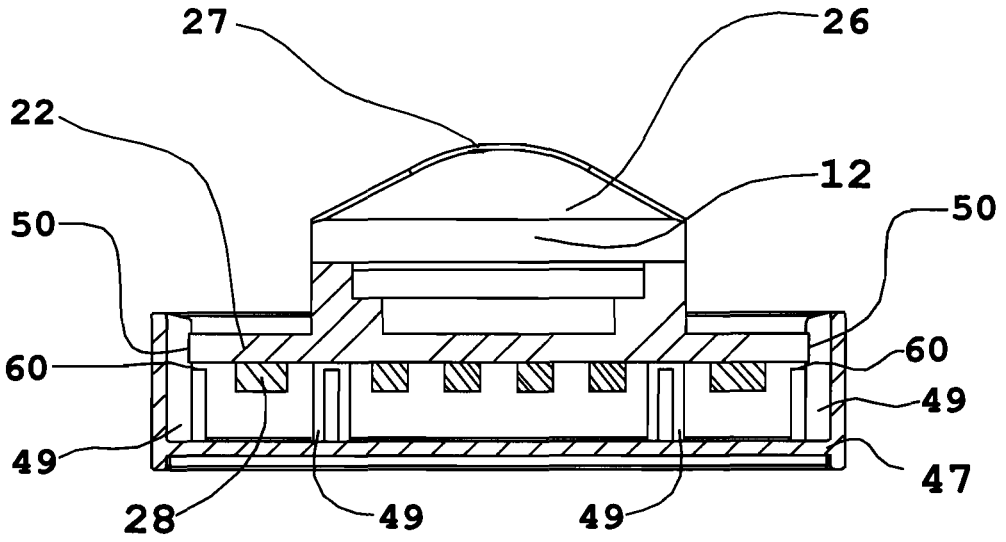
FIG. 8 is a cross section taken along line D-D in FIG. 7.

In order to remove the print element assembly 12 from the hand printer, the hand printer is adjusted so that the die plate 14 is in its extended position with the print element 28 on the removable print element assembly 12 facing outward. The printer is then held in upright alignment, over a storage cassette 47, as shown in FIGS. 7 and 8 which is sized to receive the print element assembly 12. The user then applies gentle finger tip pressure to the removal actuator 26 in a direction opposite to the magnetic attraction between the print element assembly and the hand printer (usually downward pressure). Since the removal actuator comprises a raised projection, pressure applied to the removal actuator will cause it to break the magnetic attraction between the support (in this embodiment, the shaft 18) and the print carrier 22 when the pressure is applied. The print element assembly 12 will then drop into the storage cassette with the print element facing downward. A further gentle downward pressure may be applied to the removal actuator 26 to secure the print element assembly 12 in the storage cassette 47 with a friction fit. There is no direct manual manipulation of the mechanism which removably secures the print element assembly which might cause wear and tear on component parts. Instead, there is only the application of gentle pressure to the removal actuator. By following this method the user's fingers never come into contact with the print element where they could become soiled with ink. The storage cassette also prevents the printing element from soiling items during storage. When the printing element is to be used it is loosened from the friction fit in the storage cassette by grasping the two sides of the removal actuator, and then the hand printer is aligned above the print carrier. The magnetic engagement occurs without the print carrier being touched and the user will not soil their fingers from the previously used printing element.

FIGS. 7 and 8 show detail of the storage cassette 47 and the manner in which the print element assembly 12 is stored within the storage cassette. The storage cassette 47 has a plurality of retainers 49 spaced around its perimeter. The retainers 49 preferably each have a slight taper near their tops to guide the print element assembly 12 into the storage position within the cassette 47. The retainers 49 may be either attached to or integral with the wall of the cassette, and they serve to create a friction fit to hold the print element assembly 12 in the storage cassette. Notches 50 can be seen in FIG. 8 frictionally retaining the print element assembly 12 within the cassette 47. There is a second wider set of ribs 60 which only extend part of the way up from the base of the cassette 47. These ribs are to land and support the outer edges of the print element assembly 12, and to limit the depth that the print element assembly 12 can go into the storage cassette 47. Thus, the ribs 60 prevent the print element 28 from soiling the bottom storage cassette and keep things clean. Preventing the print element 28 from being pressed against the bottom of the cassette 47 will also avoid damage to the print element and may extend its useful life.

The alternative embodiment of the present invention illustrated in FIGS. 9-12 will now be discussed in greater detail. Like structures in the alternative embodiment will be identified using the same reference numerals as used in the previous embodiment. In the alternative, a modified die plate 14 serves as the support capable of magnetic engagement. The die plate 14 may be constructed of a magnetic metal to enable it to be attracted to a magnetic surface on the print element assembly 22. Optionally the die plate 14 may be constructed from, or inset with magnetic material. The relative positioning of magnetic portions must be such that there is attraction between the print carrier 22 and all four corners of the die plate 14. It is necessary to have complete alignment and contact between the die plate and the print carrier 22 in order to achieve a good quality print. Optionally the magnetic surface 24 may be either a second magnet oriented for attractive polarity with the first object being a magnet of opposite polarity situated in the die plate 14 or the original magnet can be replaced with a magnetic metal suitable for magnetic engagement. The die plate assembly 14 has a magnetic surface 48 incorporated in the assembly to create a magnetic attraction to the opposite polarity magnet of the magnetic metal in the print carrier assembly 22. Specifically, the surface for magnetic engagement 48 can be constructed in the form of a block of magnetic material held in place on the die plate 14 by a fastening means. Although other arrangements of the fastening means may be routinely substituted, the means illustrated in FIGS. 9-12 is for framing brackets 53 to be mounted to either end of the die plate 14 with the member 48 resting within them. Tabs 52 on the framing brackets 53 hold the member 48 securely in place. The shaft 18 has been replaced with added pivot points 51 to allow rotation of the die plate 14, The pivot point 51 no longer needs to be made of magnetic metal and in the 14 may preferably constructed from plastic. The original actuator 26 on the print carrier remains the method to break the magnetic force fields and remove the print carrier from the hand printer. The magnetic attraction between the print carrier 22 and the die plate 14 does not change in function with the alternative techniques of creating magnetic engagement of the parts. The conventional hand stamps and pre-inked stamps utilize both alternative methods of securing the print carrier using magnetic engagement of the print carrier and the die plate of these hand printers. The handles of these stamps are attached to the die plate, either directly, or with a perpendicular link to the handle. The print carrier is magnetically engaged and the full functionality of the invention is achieved.

We claim:

1. A hand printer, comprising:

a die plate;

a support element capable of magnetic engagement attached to the die plate, the support element being located above the die plate;

a print carrier having a first side and a second side;

a surface on the first side of the print carrier for removable magnetic engagement with the support element; and a print element affixed to the print carrier on the second side, the print element being located below the die plate, wherein the print carrier is configured to be releasably attached to the die plate via magnetic engagement between the support element and the surface for removable magnetic engagement with the support element, without contact between the surface for removable engagement with the support element and the support element.

2. The hand printer of claim 1, wherein the die plate defines an opening therethrough, a removal actuator being located on the first side of the print carrier and configured to extend through the opening in the die plate when the print carrier is releasably attached to the die plate, the removal actuator having a sufficient height from the first side to break the magnetic engagement when the removal actuator is pressed in a direction opposite to that of the magnetic engagement.

3. A hand printer, comprising:

a die plate;

a support element capable of magnetic engagement attached to the die plate, the support element being located above the die plate;

a print carrier having a first side and a second side;

a surface on the first side of the print carrier for removable magnetic engagement with the support element;

a print element affixed to the print carrier on the second side, the print element being located below the die plate; and a removal actuator disposed on the first side of the print carrier, wherein the removal actuator comprises a first side wall and a second side wall having a sufficient height from the first side to break the magnetic engagement between the support element and the print carrier when the removal actuator is pressed in a direction opposite to that of the magnetic engagement, wherein the first side wall and the second side wall define a channel therebetween, wherein the surface for removable magnetic engagement is located within said channel, wherein the first side wall and the second side wall are disposed on opposite sides of the support element, and wherein the print carrier is releasably attachable to the die plate so that the surface for removable engagement with the support element floats in the magnetic engagement closely adjacent to, but outside physical contact with, the support element.

4. The hand printer of claim 3, wherein the first and second side walls of the removal actuator extend through the die plate opening.

5. The hand printer of claim 3, wherein the surface for removable magnetic engagement with the support element is magnetic.

6. The hand printer of claim 5, wherein the surface for removable magnetic engagement with the support element is the surface of a magnet fixed to the print carrier.

7. The hand printer of claim 6, wherein the surface for removable magnetic engagement with the support element is the surface of a magnet embedded in the print carrier.

8. The hand printer of claim 7, wherein the die plate is substantially rectangular and has four corners, and the surface for removable magnetic engagement with the support element is sufficiently strong to assure contact between the four corners of the die plate and the print carrier assembly.

9. The hand printer of claim 3, wherein the removal actuator is adjacent to the surface for removable magnetic engagement with the support element.

10. The hand printer of claim 9, wherein the removal actuator has a curved profile.

11. The hand printer of claim 10, further comprising:

a guide for aligning the surface for removable magnetic engagement with the support element.

12. The hand printer of claim 11, wherein the alignment guide comprises an inward tapering of the first and second side walls of the removal actuator.

13. The hand printer of claim 12, further comprising:

an extended thickness at the edges of first and second side walls of the actuator to prevent relative movement between the print carrier and the support element.

14. The hand printer of claim 3, wherein the surface for removable magnetic engagement with the support element is comprised of a magnetic metal and the support element is comprised of a magnet.

15. The hand printer of claim 3, wherein the support element capable of magnetic engagement comprises a horizontal shaft about which a die plate is rotatable.

16. The hand printer of claim 3, wherein the support element capable of magnetic engagement comprises a block fixed to the die plate.

17. The hand printer of claim 3, wherein the print carrier is securable with a friction fit to a storage cassette.

18. The hand printer of claim 3, wherein the removal actuator is configured to extend through the opening in the die plate when the print carrier is releasably attached to the die plate, the removal actuator having a sufficient height from the first side to break the magnetic engagement when the removal actuator is pressed in a direction opposite to that of the magnetic engagement.

* * * * *